US005887998A

United States Patent [19]

Ishikawa

[11] Patent Number: 5,887,998

[45] Date of Patent: Mar. 30, 1999

[54] TRACTOR-FEED UNIT

[75] Inventor: Yutaka Ishikawa, Tokyo, Japan

[73] Assignee: Asahi Kogaku Kogyo Kabushiki Kaisha, Tokyo, Japan

[21] Appl. No.: 940,953

[22] Filed: Oct. 8, 1997

[30] Foreign Application Priority Data

Oct. 24, 1996 [JP] Japan ..... 8-299711

[51] Int. Cl.[6] ..... B41J 11/26

[52] U.S. Cl. ..... 400/616.2; 400/611

[58] Field of Search ..... 400/616.2, 616.1, 400/618, 619, 611

[56] References Cited

U.S. PATENT DOCUMENTS

| | | | |
|---|---|---|---|
| 4,890,140 | 12/1989 | Negoro et al. | 355/290 |
| 4,987,448 | 1/1991 | Chikama et al. | 355/205 |
| 5,018,887 | 5/1991 | McCray et al. | 400/616.1 |
| 5,061,967 | 10/1991 | Isobe et al. | 355/310 |
| 5,354,139 | 10/1994 | Barrus et al. | 400/616.1 |
| 5,515,149 | 5/1996 | Ishikawa et al. | 355/308 |
| 5,718,527 | 2/1998 | Fujimoto et al. | 400/616.1 |

FOREIGN PATENT DOCUMENTS

| | | | |
|---|---|---|---|
| 0137982 | 10/1981 | Japan | 400/616.1 |

OTHER PUBLICATIONS

Darwin et al., "Bidirectional Printer Carriage", IBM Technical Disclosure Bulletin, vol. 15, No. 1, Jun. 1972, p. 157.

*Primary Examiner*—Edgar Burr
*Assistant Examiner*—Anthony H. Nguyen
*Attorney, Agent, or Firm*—Greenblum & Bernstein, P.L.C.

[57] ABSTRACT

The tractor-feed unit has a pair of first and a pair of second rollers rotatably supported by frame members. A pair of endless tractor belts are wound around the first and second pair of rollers. The tractor belt has protrusions, with which sprocket holes formed in a continuous sheet are engaged. A central portion of each of the frame members is bent to form a guide member, which is engaged with an upper and peripheral edge of a tractor belt, so that a tractor belt is deflected downward. Thus, the protrusions are separated from the sprocket holes to a position, corresponding to a guide member, below the continuous sheet.

6 Claims, 4 Drawing Sheets

TRACTOR-FEED UNIT

BACKGROUND OF THE INVENTION

1. Field of the Invention

The present invention relates to a tractor-feed unit, mounted in a printer which prints text, images and the like, which feeds a continuous sheet.

2. Description of the Related Art

Conventionally, a continuous sheet used in a printer is provided with sprocket holes, which are arranged on both sides of the continuous sheet in order to maintain alignment in the longitudinal direction, perforated at a constant interval along the feed tracks. The printer is provided with a tractor-feed unit having protrusions engagable with the sprocket holes. The diameter of a protrusion is smaller than that of a sprocket hole so that the continuous sheet is easily fed onto the printer, and so that the continuous sheet may be easily removed from the printer after a printing operation.

The tractor-feed unit is disposed between a transfer unit and a fixing unit, to maintain a continuous sheet feed speed. The fixing unit has a pair of rollers which sandwich and feed the continuous sheet, allowing the feeding speed of the fixing unit to be varied in comparison with a feeding speed of the tractor-feed unit, which is essential because of the thickness of the sheet, roughness (i.e., friction coefficient) of the sheet, friction generated by a rubber roller of the fixing unit, and so on. Therefore, the rotational speed of the rollers is controlled so that tension generated in the continuous sheet located between the fixing unit and the tractor-feed unit is kept constant.

Since there is a gap between the sprocket holes of the continuous sheet and the protrusions of the tractor-feed unit, if the rotational speed of the rollers of the fixing unit is changed, to temporarily alter the feeding speed of the continuous sheet, the feeding speeds of the continuous sheet relative to the tractor-feed unit and the transfer unit are changed. As a result, a transfer offset occurs, and thus, the quality of the text or image printed on the sheet can be lowered. Further, if a disturbance or fluctuation occurs at the inlet of the printer, i.e., if the continuous sheet is pulled or disturbed in a direction opposite to the feed direction (see an arrow B shown in FIG. 1), the same problem described above would occur.

SUMMARY OF THE INVENTION

Therefore, an object of the present invention is to provide a tractor-feed unit in which the feeding speed of the continuous sheet is not changed at the transfer unit, and thus the transfer offset does not occur, even if the feeding speed of the continuous sheet is changed at the fixing unit.

According to the present invention, there is provided a tractor-feed unit feeding a continuous sheet in which the sprocket holes are perforated at a constant interval, the sprocket holes being arranged on a line along which the continuous sheet is fed. The tractor-feed unit comprises an endless tractor belt, a belt drive source and separating means.

The endless tractor belt has protrusions which are provided at an interval equal to that of the interval of the sprocket holes so as to be engagable with the sprocket holes. The belt drive source rotates the tractor belt in the longitudinal direction thereof. The separating means separates the tractor belt from the continuous sheet so that at least one of the protrusions does not interfere with the continuous sheet. The protrusions are engaged with a leading-edge portion of the sprocket holes in a direction to the fore of the separating means, and are engaged with a trailing-edge portion of the sprocket holes in a direction to the rear of the separating means.

Further, according to the present invention, there is provided a tractor-feed unit feeding a continuous sheet in which sprocket holes are perforated at a constant interval, the sprocket holes being arranged on a line along which the continuous sheet is fed, the tractor-feed unit comprising a first endless tractor belt, a second endless tractor belt and a belt drive source.

The first endless tractor belt has protrusions which are provided at an interval equal to that of the interval of the sprocket holes so as to be engagable with the sprocket holes. The first endless tractor belt being extended along the line. The second endless tractor belt has protrusions which are provided at an interval equal to that of the interval of the sprocket holes so as to be engagable with the sprocket holes, the second endless tractor belt being extended along the line. The belt drive source rotates the first and second endless tractor belts in the longitudinal direction thereof. The first and second endless tractor belts are disposed in such a manner that the protrusions of the first endless tractor belt are engaged with a leading-edge portion of the sprocket holes, and the protrusions of the second endless tractor belt are engaged with a trailing-edge portion of the sprocket holes.

BRIEF DESCRIPTION OF THE DRAWINGS

The present invention will be better understood from the description of the preferred embodiments of the invention set forth below, together with the accompanying drawings, in which.

DESCRIPTION OF THE PREFERRED EMBODIMENTS

Figure 1:
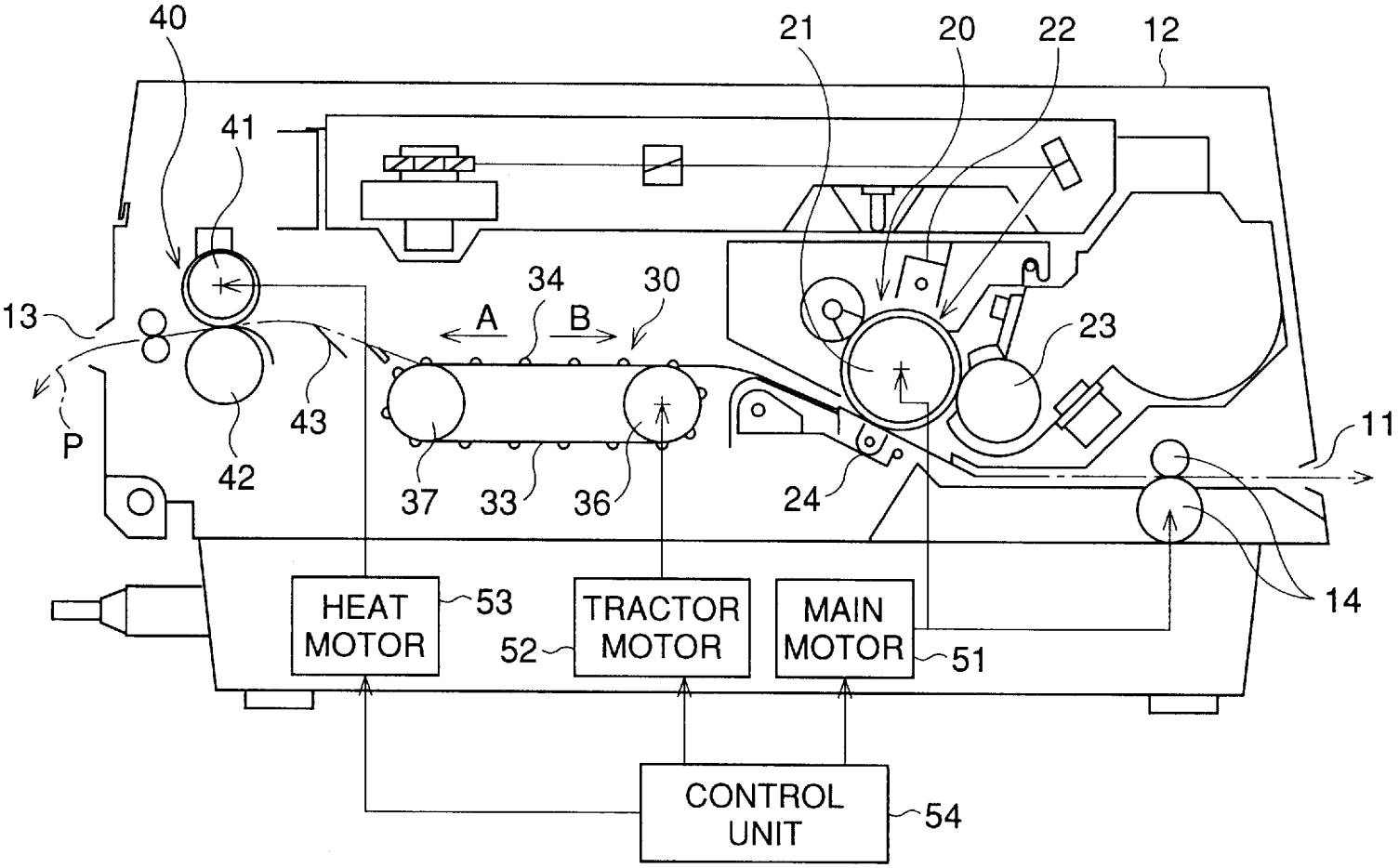
FIG. 1 is a view showing a general construction of a laser printer to which a first embodiment of the present invention is applied.

The present invention will be described below with reference to embodiments shown in the drawings.

Figure 2:
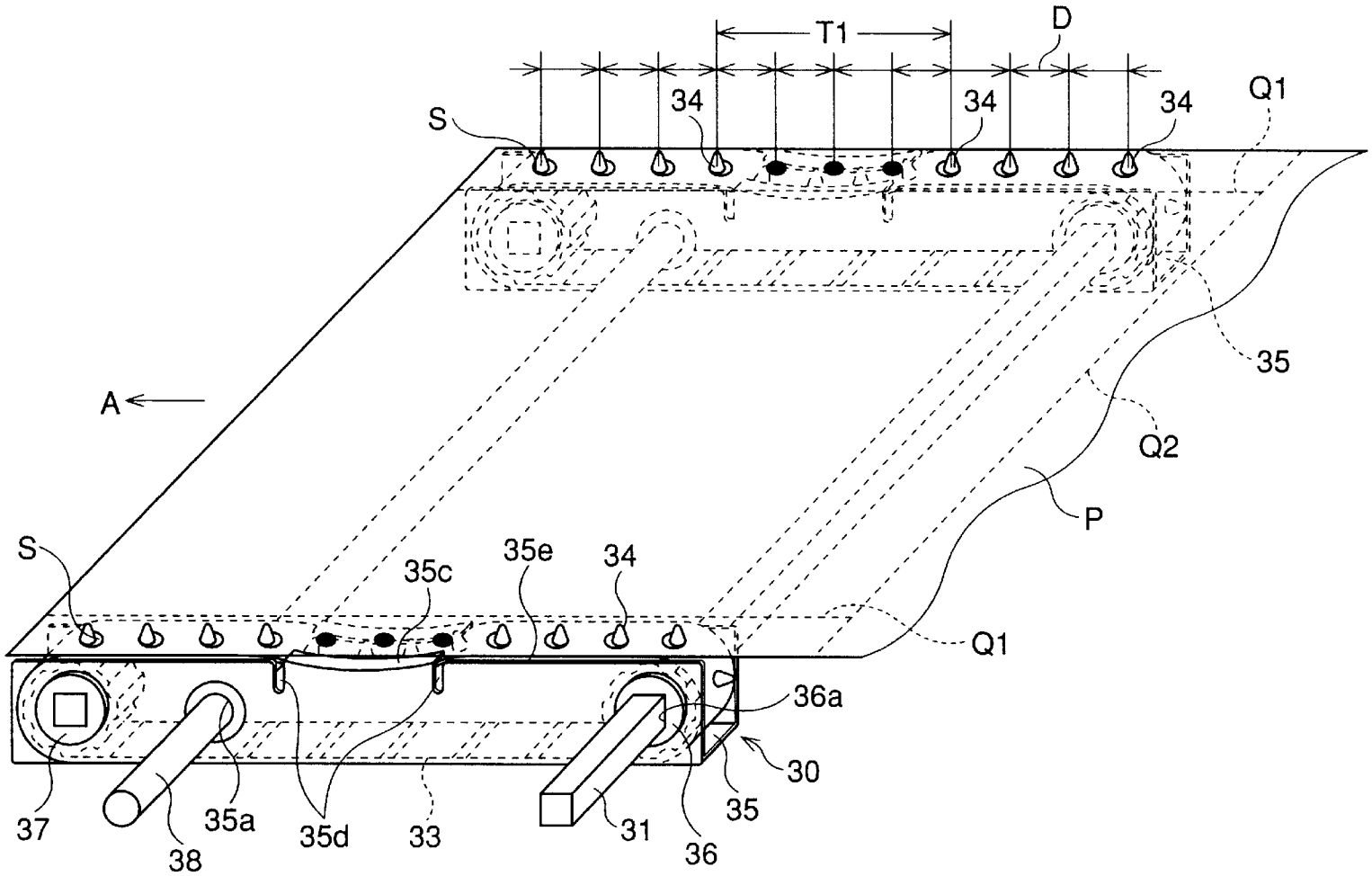
FIG. 2 is a perspective view showing a tractor-feed unit of the first embodiment to which a continuous sheet is attached.
Figure 3:
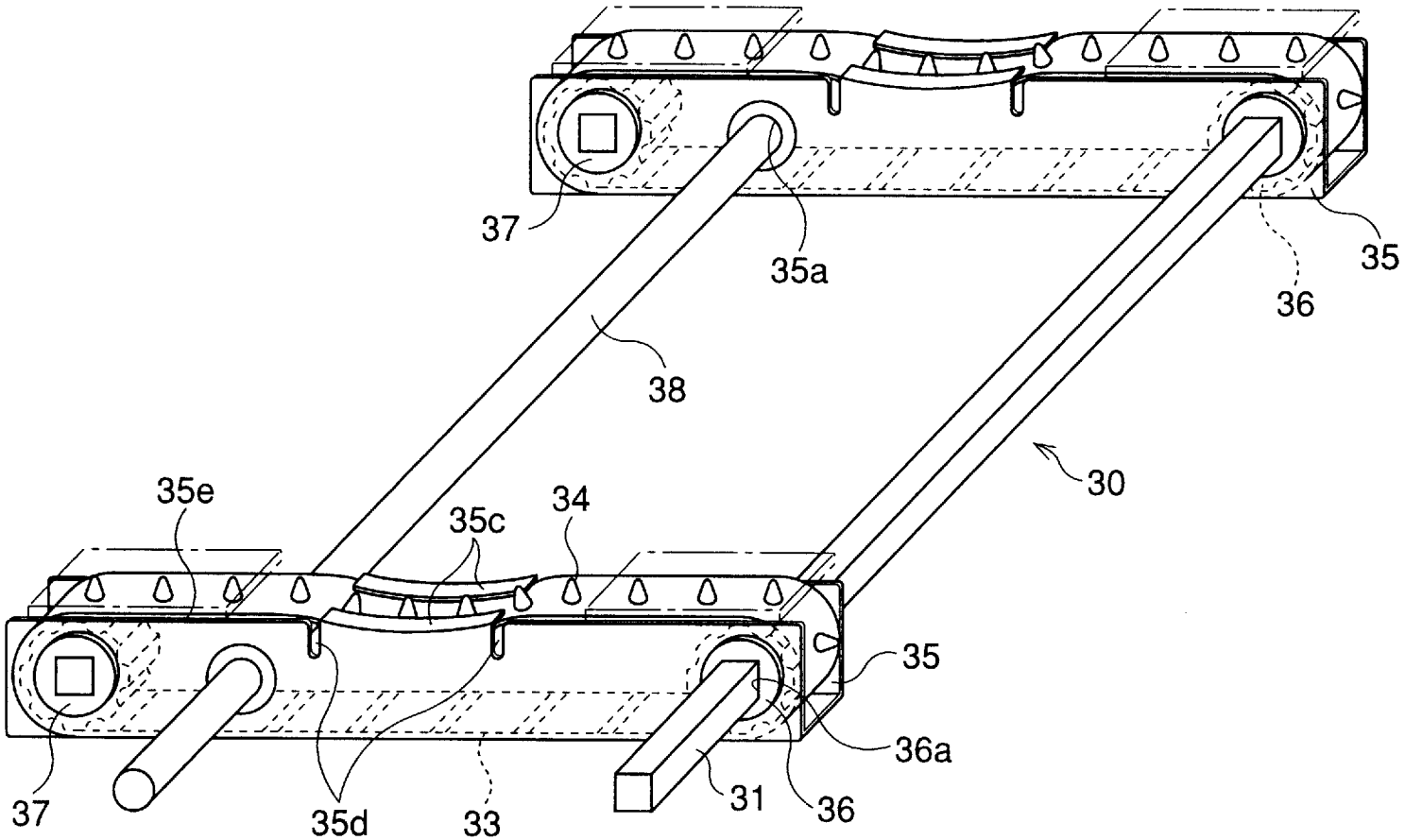
FIG. 3 is a perspective view showing the tractor-feed unit from which a continuous sheet is removed.

FIG. 1 shows a general construction of a laser printer to which a first embodiment of the present invention is applied. FIG. 2 shows a tractor-feed unit of the first embodiment to which a continuous sheet has been attached. FIG. 3 shows the tractor-feed unit from which a continuous sheet has been removed.

A continuous sheet P is inserted into a printer housing 12 through an inlet mouth 11, so that sprocket holes S are engaged with respective protrusions 34 of a tractor-feed unit 30 (shown in FIG. 2). While the continuous sheet P is fed in a direction shown by an arrow A, by the tractor-feed unit 30, a toner image is transferred to the continuous sheet P by a transfer unit 20. The toner image is thermofixed by a fixing unit 40, and then, the continuous sheet P is discharged from a discharge mouth 13.

In the transfer unit 20, a photosensitive drum 21 is provided above a feeding path along which the continuous sheet P is fed. A charger 22 is provided above the photosensitive drum 21, a developing unit 23 is provided beside the photosensitive drum 21, and an electrical discharge unit 24 is disposed beneath the photosensitive drum 21. The tractor-feed unit 30 has a pair of endless tractor belts 33 wound around a pair of first and a pair of second rollers 36 and 37, and a plurality of protrusions 34 are provided on each tractor belt 33. In the fixing unit 40, a heat roller 41 is disposed above the feeding path of the continuous sheet P, and a press roller 42 is provided under the feeding path to simultaneously press and feed the continuous sheet P, in association with the heat roller 41. A tension sensor 43, which senses tension occurring in the continuous sheet P, is disposed between the fixing unit 40 and the tractor-feed unit 30. A pair of back-tension rollers 14, which rotate at a lower rate than the tractor-feed unit 30, are provided between the inlet mouth 11 and the transfer unit 20, to feed the continuous sheet P towards the transfer unit 20, thereby maintaining tension in the continuous sheet P to the rear of the feeding path.

The back-tension rollers 14 and the photosensitive drum 21 are rotated by a main motor 51, and a drive shaft 31 of the tractor-feed unit 30 is rotated by a tractor motor 52. The heat roller 41 of the fixing unit 40 is rotated by a heat motor 53. These motors 51, 52 and 53 are controlled by a control unit 54.

As shown in FIG. 2, numerous sprocket holes S are formed as feed tracks on both sides of the continuous sheet P to extend in the longitudinal direction or the feeding direction thereof. The sprocket holes S are perforated at a constant interval. Further, a pair of first perforations Q1, each extending along a series of the sprocket holes S, are formed in the continuous sheet P. Second perforations Q2 are formed in and extend over a breadth direction of the continuous sheet P. The protrusions 34, formed on the tractor belts 33, have a diameter smaller than, but an interval pitch equivalent to, that of the sprocket holes S.

The tractor-feed unit 30 has a pair of frame members 35, each of which comprises a U-shaped sectional channel. First and second pairs of rollers 36 and 37 are mounted in each of the frame members 35. A first roller 36 has a square hole 36*a* into which the drive shaft 31 having a square section is inserted. The drive shaft 31 is connected to the tractor motor 52 which is the drive source for the tractor belt. A frame member 35 has a round hole 35*a*, into which a guide shaft 38 is inserted, so that the distance between the frame members 35 can be adjusted to fit the breadth of the continuous sheet P, by moving one of the frame members 35 along the guide shaft 38.

An upper and central portion of each of the frame members 35 is bent inside to form a guide member 35*c*. Namely, each of the guide members 35*c* is extended in the feeding direction of the continuous sheet P. Notches 35*d* are formed on both sides of a guide member 35*c*. Each tractor belt 33 is extended adjacent to an upper edge 35*e* of the respective frame member 35, and the respective guide member 35*c* is engaged with both peripheral edges of an upper surface of the tractor belt 33. (See FIG. 3). Each guide member 35*c* is deflected downward in comparison with an upper edge 35*e*, and the deflection amount of each guide member 35*c* is set so that the feeding path of the continuous sheet P is deflected downward in such a manner that the protrusions 34, which are located at a portion corresponding to each guide member 35*c*, do not locate with the sprocket holes of the continuous sheet P. Namely, due to the guide members 35*c*, the pair of tractor belts 33 are separated from the continuous sheet P, so that the protrusions 34 are positioned below the continuous sheet P at the portions of the guide members 35*c*.

The distance T1 between the protrusions 34, which are positioned close to the notches 35*d* and are engaged with the sprocket holes S, is expressed using a distance D between two adjacent protrusions 34 as the following equation (1):

$$T1=D\times X+\alpha \quad (1)$$

wherein "X" means a positive integer, "α" is a difference between the diameter of a sprocket hole S and the diameter of a protrusion 34.

In the first embodiment, the length of the guide member 35*c* is approximately three times the distance D between two adjacent protrusions 34, whereas the number of sprocket holes S and the number of protrusions 34, positioned in the distance T1, is three and four, respectively. Namely, over the distance T1, due to each of the guide members 35*c*, four protrusions 34 are positioned in four pitches of the sprocket holes S.

Since these guide members 35*c* are provided, the protrusions 34 are engaged with a leading-edge portion of the sprocket holes S in a direction to the fore of the guide members 35*c*, and are engaged with a trailing-edge portion of the sprocket holes S in a direction to the rear of the guide members 35*c*. Therefore, even if the feeding speed of the continuous sheet P is raised at the fixing unit 40, since the protrusions 34 located at the rear of the guide members 35*c* are engaged with a trailing-edge portion of the sprocket holes S, the feeding speed of the continuous sheet P is always constant at the transfer unit 20, i.e., the feeding speed of the continuous sheet P is not raised at the transfer unit 20. Similarly, even if the feeding speed of the continuous sheet P is lowered at the fixing unit 40, since the protrusions 34 located at the fore of the guide members 35*c* are engaged with a leading-edge portion of the sprocket holes S, the feeding speed of the continuous sheet P is not lowered at the transfer unit 20. Accordingly, the transfer offset is prevented, so that the quality of the printed image is improved.

Figure 4:
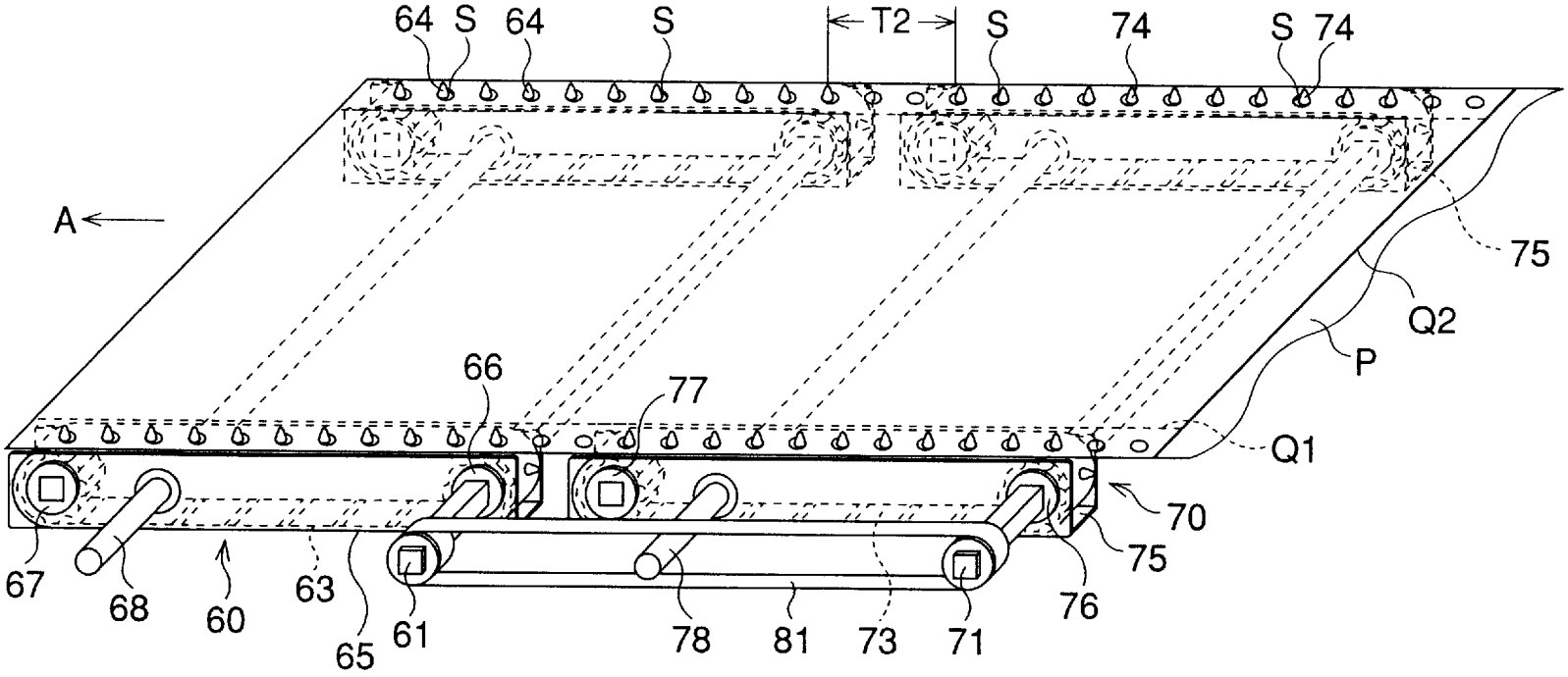
FIG. 4 is a perspective view showing a tractor-feed unit of a second embodiment to which a continuous sheet is attached.

FIG. 4 shows a second embodiment of the present invention.

The second embodiment is different from the first embodiment in that the tractor-feed unit is divided into first and second tractor-feed units 60 and 70. The first tractor-feed unit 60 is disposed to the fore of the feed direction of the continuous sheet P, and the second tractor-feed unit 70 is disposed to the rear of the feed direction of the continuous sheet P. These tractor-feed units 60 and 70 are separated from each other by a predetermined distance T2.

In the first tractor-feed unit 60, a pair of first and a pair of second rollers 66 and 67 are mounted in each-frame member 65. A pair of first tractor belts 63 are wound around the rollers 66 and 67. A drive shaft 61 is inserted into a first roller 66, and is connected to a tractor motor (not shown) which is the drive source for a tractor belt 63. One of the frame members 65 is movable along the guide shaft 68, so that the distance between the frame members 65 can be adjusted to fit the breadth of the continuous sheet P.

The second tractor-feed unit 70 has the same construction as that of the first tractor-feed unit 60, and in the second tractor-feed unit 70, "10" has been added to the reference numerals of members corresponding to the first tractor-feed unit 60. A connecting belt 81 is wound around both the drive shaft 61, connected to a tractor belt 63 of the first tractor-feed unit 60, and a drive shaft 71, connected to a tractor belt 73 of the second tractor-feed unit 70. Therefore, the first and second tractor belts 63 and 73 are inextricably driven to rotate at the same speed.

The pairs of first and second tractor belts 63 and 73 are disposed in such a manner that the protrusions 64 of the first tractor belts 63 are engaged with a leading-edge portion of the sprocket holes S, and the protrusions 74 of the second tractor belts 73 are engaged with a trailing-edge portion of the sprocket holes S. Namely, the distance T2 between a protrusion 64 of each of the first tractor belts 63, which is closest to the second tractor belt 73 and which is also engaged with a sprocket hole S, and a protrusion 74 of each of the second tractor belts 73, which is closest to the first tractor belt 63 and which is also engaged with a sprocket hole S, is expressed as follows:

$$T2=D\times X+\alpha \quad (2)$$

Therefore, according to the second embodiment, similar to the first embodiment, the continuous sheet P is always fed at a constant speed, the same effect as is obtained by the first embodiment.

Although the embodiments of the present invention have been described herein with reference to the accompanying drawings, obviously many modifications and changes may be made by those skilled in this art without departing from the scope of the invention.

The present disclosure relates to subject matter contained in Japanese Patent Application No. 8-299711 (filed on Oct. 24, 1996) which is expressly incorporated herein by reference, in its entirety.

I claim:

1. A tractor-feed unit feeding a continuous sheet in which sprocket holes are formed at a constant interval, said sprocket holes being arranged on a line along a feeding direction of the continuous sheet, said tractor-feed unit comprising:

an endless tractor belt having protrusions provided at an interval equal to that of said constant interval of said sprocket holes so as to be engageable with said sprocket holes;

a belt drive source for rotating said tractor belt in the longitudinal direction thereof; and means for separating said tractor belt from said continuous sheet so that at least one of said protrusions does not interfere with said continuous sheet; said means for separating creating a path for said tractor belt which is longer than the path of said continuous sheet such that said protrusions are engaged with a leading-edge portion of said sprocket holes downstream of said separating means in said feeding direction, and are engaged with a trailing-edge portion of said sprocket holes upstream of said separating means in said feeding direction.

2. A tractor-feed unit according to claim 1, wherein said separating means comprises a guide member by which said tractor belt is deflected.

3. A tractor-feed unit according to claim 2, wherein said guide member is extended along said line, and is engaged with a peripheral edge of said tractor belt which extends along said line.

4. A tractor-fed unit according to claim 1, said guide member being shaped to curve said endless tractor belt away from the continuous sheet such that a number of said protrusions located at a position corresponding to said guide member is greater than a number of said sprocket holes located at a position corresponding to said guide member.

5. A tractor-feed unit feeding a continuous sheet in which sprocket holes are formed at a constant interval, said sprocket holes being arranged on a line in a feeding direction of the continuous sheet, said tractor-feed unit comprising:

a first endless tractor belt having protrusions provided at an interval equal to that of said constant interval of said sprocket holes so as to be engageable with said sprocket holes, said first endless tractor belt extending along said line;

a second endless tractor belt having protrusions provided at an interval equal to that of said constant interval of said sprocket holes so as to be engageable with said sprocket holes, said second endless tractor extending along said line; and a belt drive source for rotating said first and second endless tractor belts in the longitudinal direction thereof, such that said first and second endless tractor belts are disposed with said protrusions of said first endless tractor belt engaged with a leading-edge portion of said sprocket holes, and said protrusions of said second endless tractor belt engaged with a trailing-edge portion of said sprocket holes.

6. A tractor-feed unit according to claim 5, further comprising drive shafts connected to said first and second endless tractor belts, respectively, and said belt drive source comprising a connecting belt wound around said drive shafts so that said first and second endless tractor belts are rotated in synchronization with each other.

* * * * *

UNITED STATES PATENT AND TRADEMARK OFFICE

CERTIFICATE OF CORRECTION

PATENT NO. : 5,887,998

DATED : March 30, 1999

INVENTOR(S) : Y.ISHIKAWA

It is certified that error appears in the above-identified patent and that said Letters Patent is hereby corrected as shown below:

At column 6, line 10 (claim 4, line 1) of the printed patent, "tractor-fed" should be —tractor-feed—.

Signed and Sealed this

Sixteenth Day of May, 2000

*Attest:*

Q. TODD DICKINSON

*Attesting Officer*

*Director of Patents and Trademarks*